US005312317A

United States Patent [19]

Voss et al.

[11] Patent Number: 5,312,317

[45] Date of Patent: May 17, 1994

[54] APPARATUS FOR DETACHING PIECES OF TUBE PROVIDED WITH TRANSVERSE WELD SEAMS FROM A WEB AND FOR STACKING THE SAME

[75] Inventors: Hans-Ludwig Voss, Tecklenberg; Andreas Schroedter, Ladbergen; Uwe Koehn, Osnabruck, all of Fed. Rep. of Germany

[73] Assignee: Windmoller & Holscher, Lengerich, Fed. Rep. of Germany

[21] Appl. No.: 982,662

[22] Filed: Nov. 25, 1992

[30] Foreign Application Priority Data

Nov. 28, 1991 [DE] Fed. Rep. of Germany ..... 4139183
Apr. 30, 1992 [DE] Fed. Rep. of Germany ..... 4214365

[51] Int. Cl.[5] ..... B31B 23/96; B31B 23/98
[52] U.S. Cl. ..... 493/194; 493/204
[58] Field of Search ..... 493/194, 195, 196, 197, 493/204

[56] References Cited

U.S. PATENT DOCUMENTS

| | | | |
|---|---|---|---|
| 3,587,410 | 6/1971 | Dechanciaux | 493/204 |
| 4,195,960 | 4/1980 | Schulze | 414/49 |
| 4,286,907 | 9/1981 | Houle et al. | 414/72 |
| 4,395,252 | 7/1983 | Lehmacher | 493/28 |
| 4,512,757 | 4/1985 | Dreckmann | 493/194 |
| 4,854,928 | 8/1989 | Fukuyama | 493/28 |
| 4,925,439 | 5/1990 | Schneider | 493/204 |
| 5,030,191 | 7/1991 | Reifenhauser | 493/204 |

FOREIGN PATENT DOCUMENTS

| | | | |
|---|---|---|---|
| 3136619 | 3/1983 | Fed. Rep. of Germany . | |
| 3201170 | 5/1983 | Fed. Rep. of Germany . | |
| 2625945 | 7/1989 | France | 493/204 |
| 982593 | 2/1965 | United Kingdom | 493/204 |

*Primary Examiner*—William E. Terrell
*Attorney, Agent, or Firm*—Keck, Mahin & Cate

[57] ABSTRACT

An apparatus for providing transverse weld seams and transverse detaching cuts or for providing detaching weld seams on a tubular or semi-tubular web of thermoplastic synthetic resin, and for stacking the detached sections includes a transverse welding and transverse detaching station for detaching sections having bottom weld seams and any leading head weld seams from the web and a stacking station for retaining or fixing the supplied sections. The web is moved intermittently. To cool the trailing weld seams of the sections without causing the sections to stick together adjacent to the bottom weld seams during stacking, a drum is provided which rotates about a transverse axis between the transverse welding and transverse detaching station and the stacking station. The wall of the drum includes at least two wall parts. The drum is adapted to be driven in step with the welding process by rotating the drum through an angular increment related to the number of wall parts of the drum in each revolution. In synchronization with stacking the cut sections at the stacking station, a path is formed for allowing the web to be pushed through gaps between the wall parts of the drum between the transverse welding and the transverse detaching station and the stacking station.

8 Claims, 7 Drawing Sheets

1
2
3
4
5
6
8
9
10

7

APPARATUS FOR DETACHING PIECES OF TUBE PROVIDED WITH TRANSVERSE WELD SEAMS FROM A WEB AND FOR STACKING THE SAME

FIELD OF THE INVENTION

The present invention relates to an apparatus for the provision of transverse weld seams and transverse detaching cuts or of transverse detaching weld seams on an intermittently pushed and/or intermittently carried tubular or semi-tubular web of thermoplastic synthetic resin and for stacking the detached sections, comprising a transverse welding and transverse detaching station for detachment of sections provided with bottom weld seams and any leading head weld seams, more particularly bag sections, from the web and a stacking station, which is provided with means for retaining or fixing the supplied sections.

BACKGROUND OF THE INVENTION

In connection with the production of bags, which are weldingly severed or detached in rapid succession from an intermittently supplied synthetic resin web and are then stacked, there is the problem in conjunction with stacking that the trailing transverse welds seams or respectively bottom weld seams come to lie on top of each other at a time at which they are not yet sufficiently cooled so that there is a danger of the superposed bottom weld seams sticking together.

A large number of devices has already been proposed which cause a cooling down of the bottom weld seams prior to stacking of the detached and welded sections or provide other means, as for instance offset deposit of the bottom weld seams, in order to prevent sticking together of weld seams in the stack.

In the case of a device of the type initially mentioned as described in the German patent publication 3,201,170 C a cooling chamber swept by blown air is provided between the transverse welding and detaching station, in which the bottom weld seams are cooled when sections are deposited on the stack. In addition to the depositing on the stack with an offset, which prevents the bottom weld seams from lying on top of each other in the stack, in the lower part of the cooling there is a rotary rake drum, on whose rotary rods constituting the outer limit thereof the ends of the sections, provided with bottom weld seams, fall in such a manner that they are caused to fan out.

SUMMARY OF THE INVENTION

One object of the invention is to provide an apparatus of the type initially mentioned which ensures efficient cooling of the trailing or bottom end weld seams of the sections so that the same may be stacked in a superposed relationship without the likelihood of sticking together adjacent the bottom weld seams.

In the case of an apparatus of the type initially mentioned this aim is to be achieved in accordance with the invention by the provision of a drum able to rotate about a transverse axis between the transverse welding and transverse detaching station and the stacking station, the enveloping cylindrical outline thereof being constituted by at least two rods or wall parts, and which is adapted to be driven in rotation in step with welding through an angular increment which amounts to a fraction corresponding to the number of rods or the like of one revolution (360°/number of rods or the like). In step with depositing a bag on the stack, there is a free path for pushing the web through gaps in the drum between the transverse welding station and the transverse detaching station and the stacking station. In this respect the drum may be driven continuously or, preferably, intermittently. After each advance of the leading end of the web and the fixing thereof in the stack forming station, the section provided with a trailing transverse weld seam and drawn off from the web is entrained by rotation of the drum of one rod constituting the enveloping cylinder or by a part of the wall so that the trailing end with the bottom weld seam is moved along a diverted path and may accordingly cool down.

It is convenient if the drum is provided with two oppositely arranged wall parts having the form of cylindrical shells.

In accordance with a further and more particularly preferred development of the invention, a sheet metal guide is provided generally in the horizontal plane within the enveloping cylinder of the drum. This sheet metal guide ensures trouble-free passage of the trailing end of the web through the gap in the drum.

In keeping with a further possible development of the invention, on the lower side of the sheet metal guide there is an elongated plenum in communication with an air duct, whose lower wall is provided with air outlet nozzles. Blowing air under pressure may be passed into this plenum so that air emerges from the nozzles which blows the respective trailing end of a welded section or of a bag downwards and the latter comes to lie on the stack being formed. In accordance with the cutouts in the outer surface of the drum the emergence of the air from the nozzle preferably occurs synchronously with rotation. The blowing air emerging from the nozzles of the plenum aids not only satisfactory deposit on the stack but also causes cooling of the weld seams.

Preferably the part of the sheet metal guide which is adjacent to the transverse welding and transverse detaching station is angled or bent downwards or so that it constitutes a ramp-like engagement part for the freely advanced end of the web.

A further advantageous feature of the invention is such that a pair of gripping jaws is arranged between the transverse welding and transverse detaching station, on the one hand, and the drum, on the other hand. A lower jaw of the pair of gripping jaws is provided with an elastic strip that in the gaps between the two rods or the like it bears on an edge part of the sheet metal guide. This elastic strip allows the gap between the gripping jaws and the sheet metal guide to be spanned so that it is impossible for there to be a jamming or hooking of the end of the tube web, which thus moves freely.

It is convenient for the lower jaw of the pair of gripping jaws to be able to be lowered and raised.

In accordance with a further possible development of the invention the edge part of the sheet metal guide nearer the stacking station has an elastic strip secured to it, which extends through the gap between the rods or the like in a radial direction. This elastic strip on the one hand spans the gap between the sheet metal guide and the stacking station or, respectively, the rear end of the stacking table of the stacking station and on the other hand during rotation of the drum it sweeps over the rear part of the section still resting on the sheet metal guide past the rear side of the next following rod or, respectively, wall part of the drum so as to form a tube and it is possible to ensure a more particularly effective cooling of the bottom weld seam.

Furthermore, it is convenient if the stack is so formed that its rear end depends freely downwards between the drum and the rear edge of a stack table. As soon as the rear parts of the stacked sections have been released, owing to rotation of the drum, from the entraining rods or wall sections, they will engage with the downwardly depending part of the stack in the course of formation.

BRIEF DESCRIPTION OF THE DRAWINGS

A working embodiment of the invention will be described with reference to the drawings, wherein.

DETAILED DESCRIPTION OF THE PREFERRED EMBODIMENTS

Figure 1:
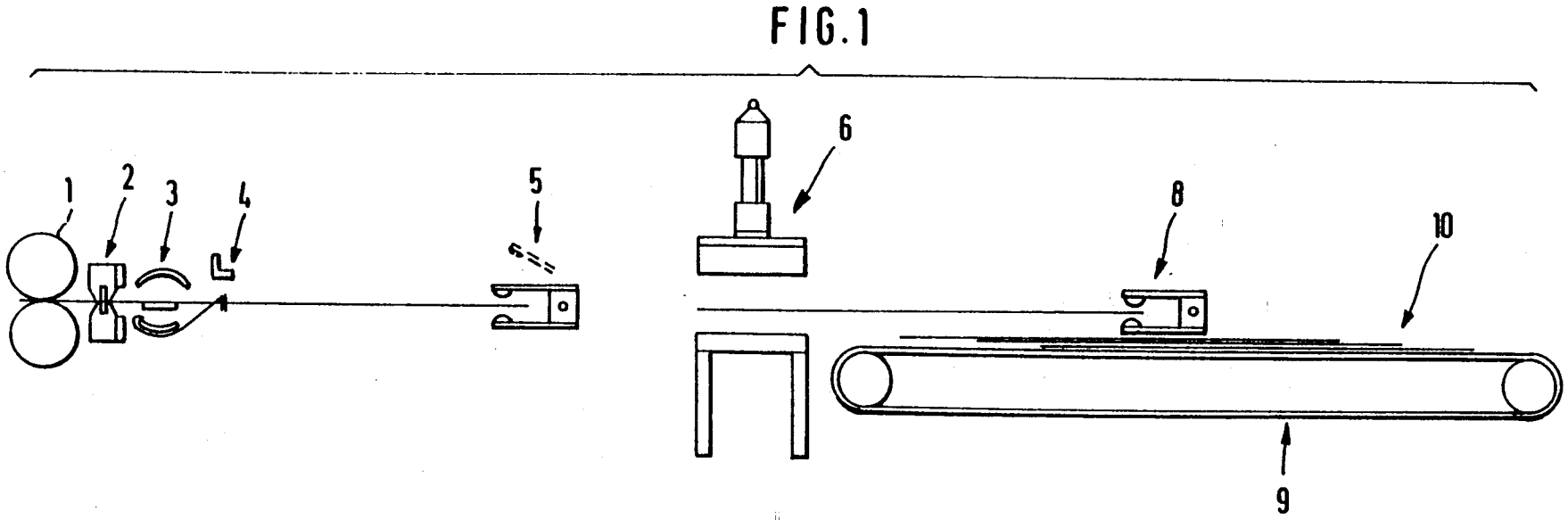
FIG. 1 shows a schematic elevational view of a device for the production of bags weldingly detached from a tubular film web, for stacking the bags and for stamping and removing the stacks of bags.
Figure 1B:
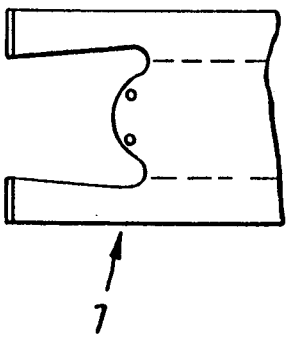
FIG. 1*b* is a plan view of an end of a bag which is provided with cutouts to constitute a tie handle bag.
Figure 1A:
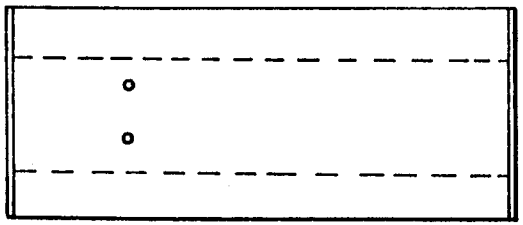
FIG. 1*a* is a plan view of a tubular section of the web having top and bottom welds, with side gusset folds and stack holes.

In the case of the device illustrated in FIG. 1, a pair 1 of feed rolls draws a double web or a flattened tubular film web of thermoplastic synthetic resin, as for instance from a supply roll, in timed steps. This pair of feed rolls is followed by a welding device 2, by which individual bags are detached from the film web. The individual bags are then supplied via a transfer device 3 to a stacking station 4. When the stack has attained a predetermined size it is engaged by a gripper carriage 5 and supplied to a stamp 6, by means of which the stack is so stamped that a stack of tie handle bags 7 results, which is then deposited on a conveyor belt 9 for removal with the individual stacks 10 being placed in overlapping relationship on the belt 9. Such a system may be conventional apart from the transfer device 3. In the following this transfer device will be described with reference to FIGS. 1 through 7 only as regards the design of this part and as regards the function of the transfer device.

Figure 2:
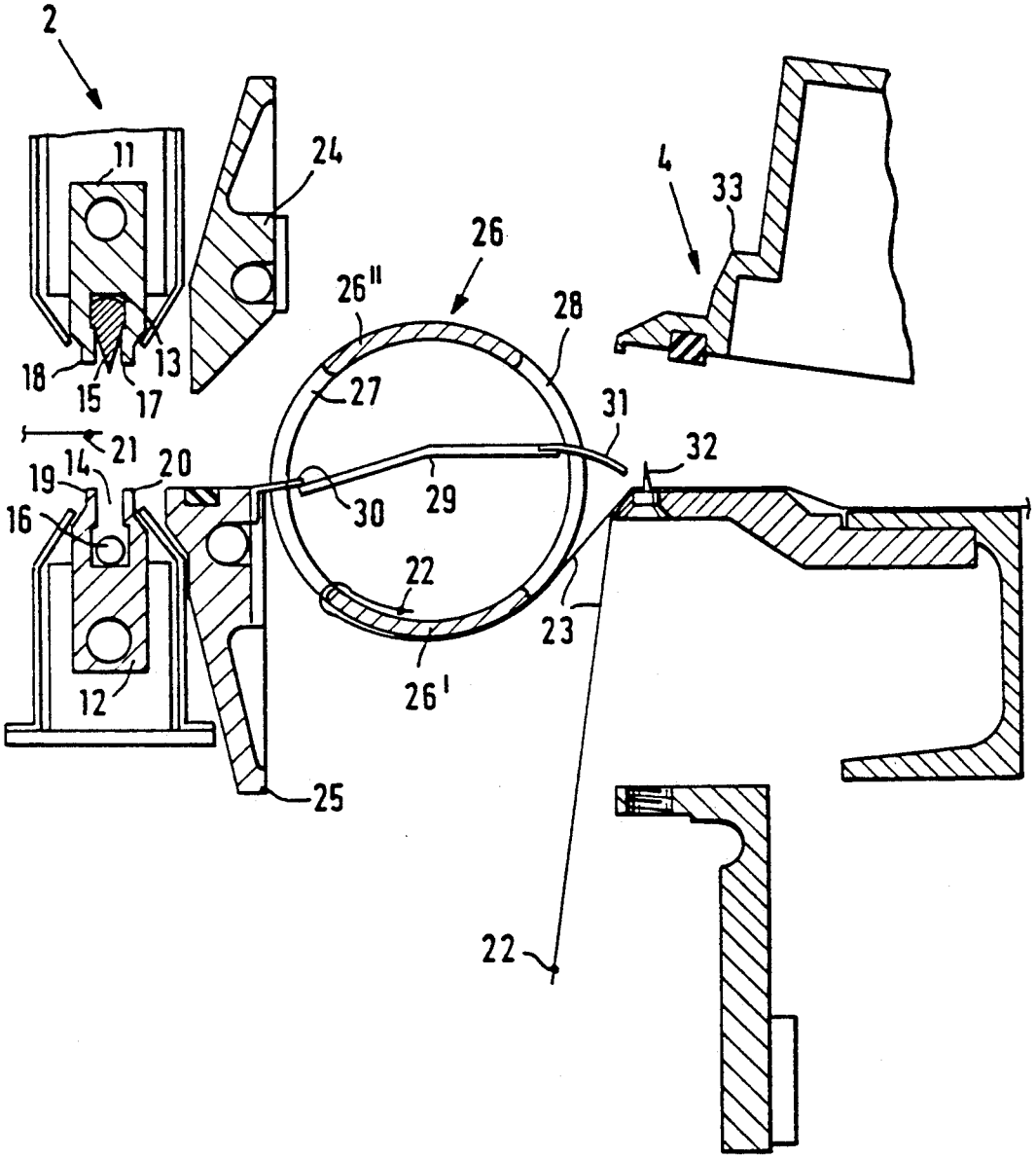
FIGS. 2 to 7 are enlarged schematic elevational views of a detail of the transverse welding and detaching station and the stacking station of the device in accordance with FIG. 1, in different working positions, the blowing air plenum which is constituted by a piece of sheet metal in the form of a cylindrical shell and connected with the lower side of the sheet metal guide being illustrated only in FIG. 7.

A welding device 2, shown in FIG. 2, has an upper welding beam 11 and a lower welding beam 12, which may be moved towards each other. The two welding beams 11, 12 each have a central groove 13, 14, a severing knife 15 being arranged in the upper groove 13, which is able to plunge into the lower groove 14 and sever or detach the tubular film web held between the welding beams 11, 12. Each welding beam 11, 12 has two welding jaws 17, 18 and 19, 20, respectively, arranged parallel to each other so that during the welding operation two weld seams extending parallel to each other are formed, between which the detaching cut is then made. FIG. 2 shows typical bags having a leading top weld 21 and a trailing bottom weld 22. The trailing bottom weld 22 is in this case located on a piece 23 of bag which has already been impaled on needles 32.

FIG. 2 shows that the welding device 2 has associated gripper jaws 24, 25 so that the film is held during the welding operation on the one hand by the gripper device 24 and 25 and on the other hand by the pair 1 of feed rolls. In the clearance between the welding device 2 and the stacking station 4 there is a tube 26 extending over the full breadth of the machine, rotatably supported in a manner which is not illustrated and having two broad, oppositely arranged slots 27 and 28. In the interior of tube 26, a sheet metal transfer member 29 is arranged, which may be fixedly mounted in the side frames of the machine.

Figure 7:
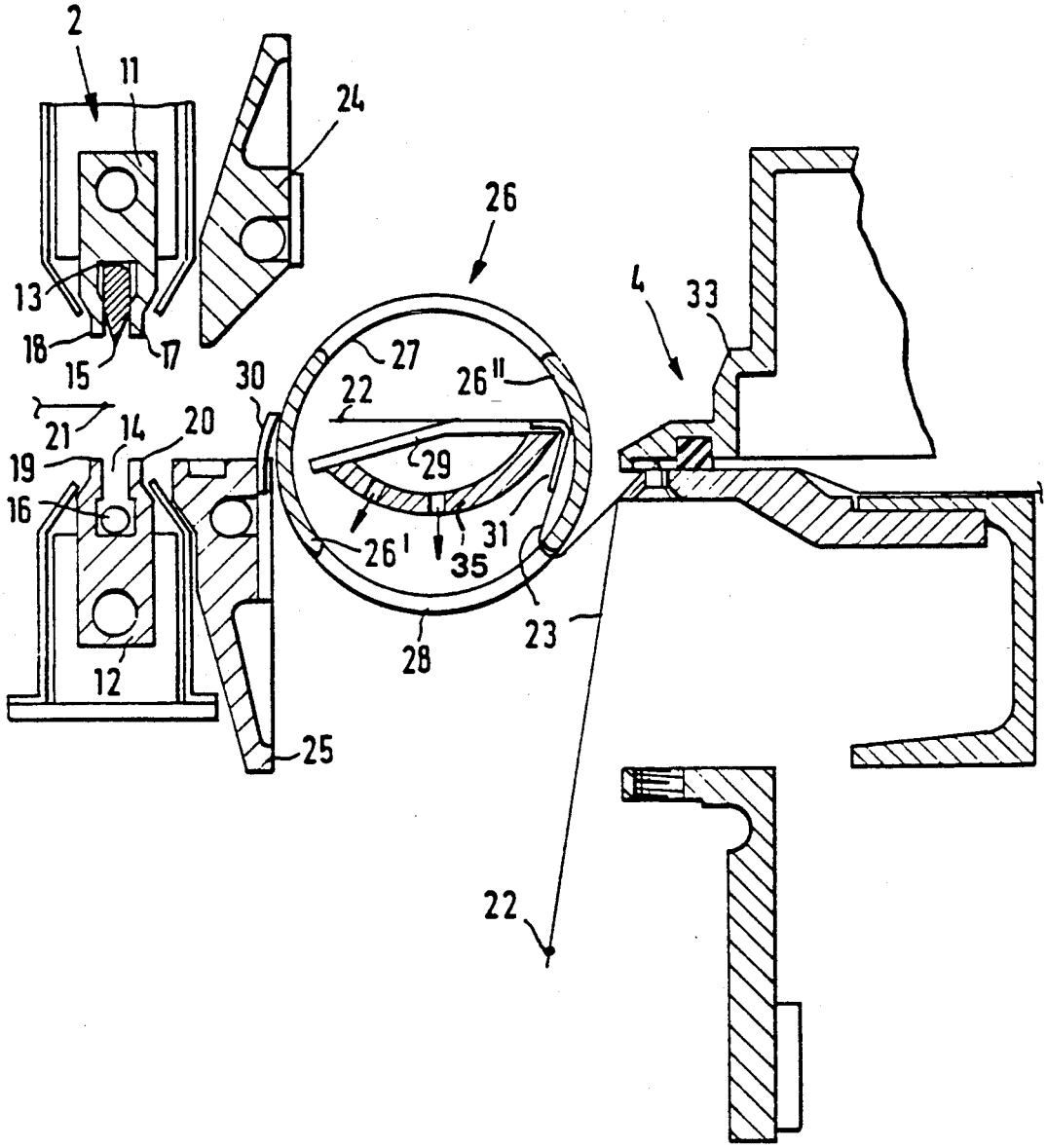

As shown in FIG. 7, it is possible in accordance with a preferred working embodiment for an arcuate sheet metal member 35, preferably in the form of an arc of a cylindrical shell, to be connected with the lower side of the sheet metal guide 29, arcuate member 35 constituting a blowing air plenum shut off by the sheet metal guide 29. The arcuate sheet metal member 35 is provided with rows of holes, which constitute blowing nozzles from which blowing air issues as indicated by the arrows. The sides of the elongated blowing air plenum are shut off by terminal sheet metal members, not illustrated, one terminal sheet metal member being provided with a connection for the supply of blowing air. The supply of blowing air is expediently switched synchronously so that air is blown out of the nozzles each time a trailing section or bag end comes clear of the respective lower outer surface of the drum 26 and has to be blown onto the dependent trailing or near part of the stack being formed.

As shown in FIG. 2, in this respect a strip 30 is fixed to the lower gripper jaw 25, such strip consisting of elastic material as for instance Teflon tape. This strip 30 spans the small distance between the lower gripper jaw 25 and the transfer sheet metal member 29. On the edge of the transfer sheet metal member 29, opposite to this strip 30, member 29 has a further strip 31, also of elastic material, fixed to it, which spans the space between the end of the transfer sheet metal member 29 and the stacking station 4.

Figure 3:
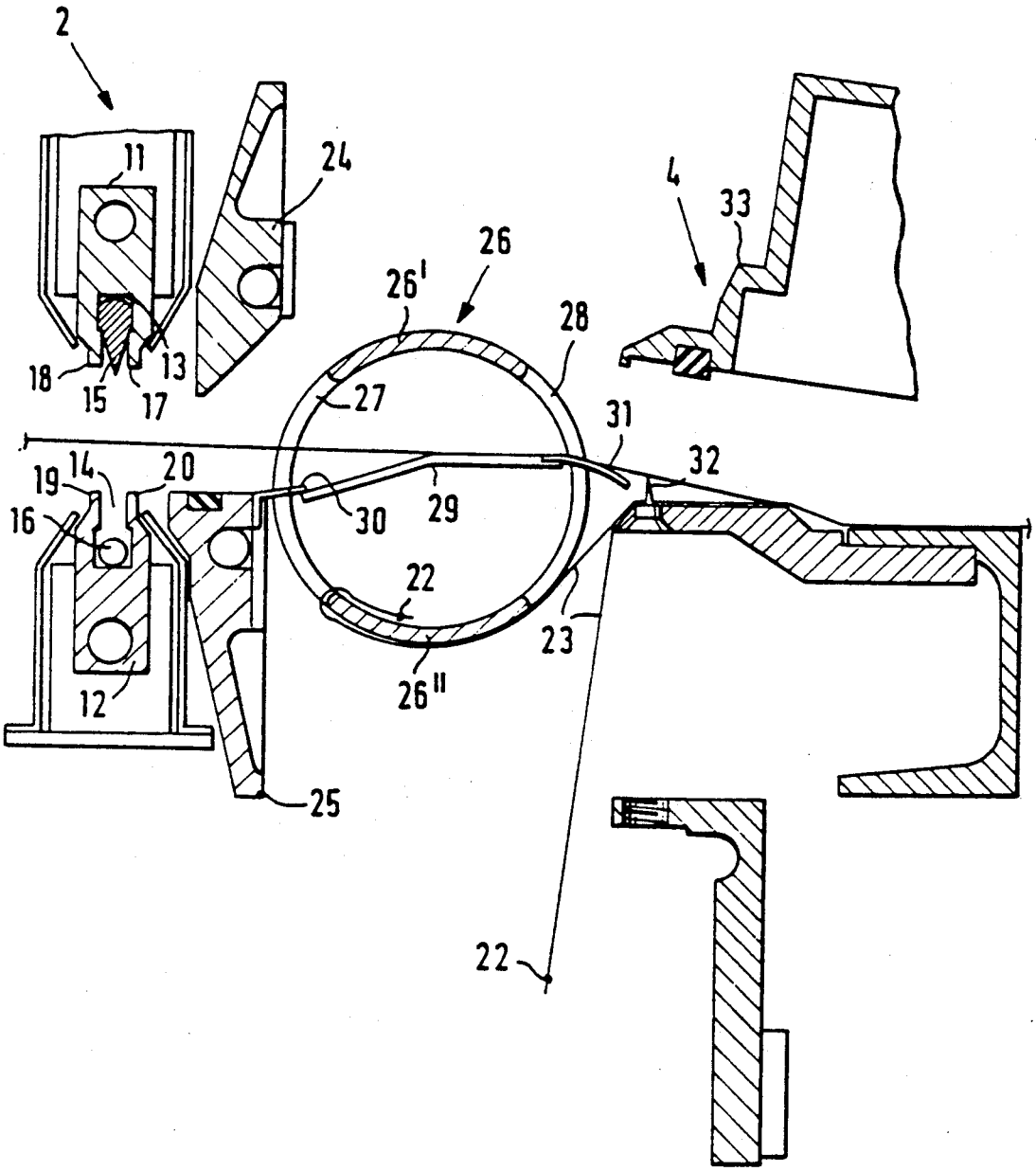
Figure 4:
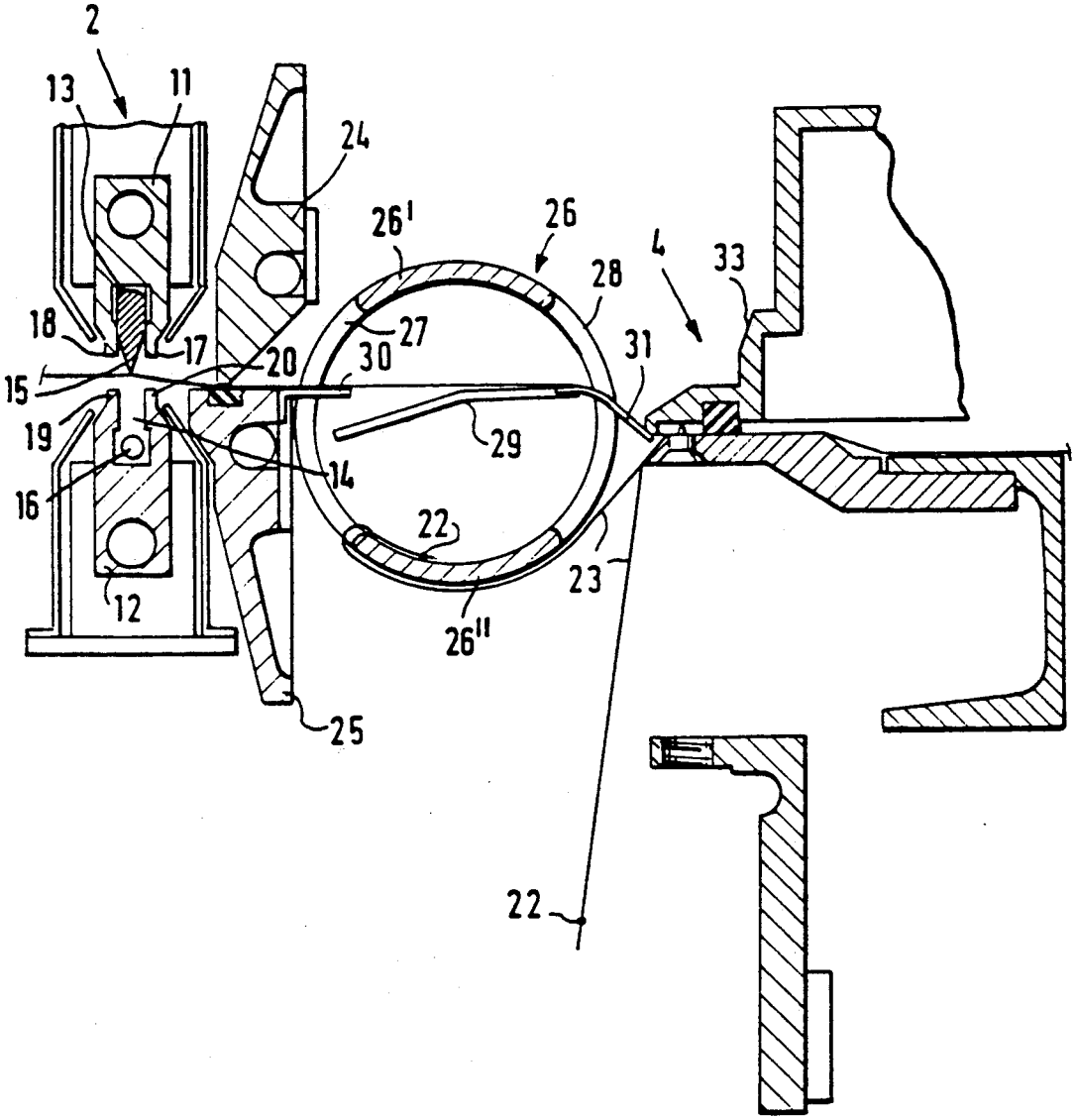
Figure 5:
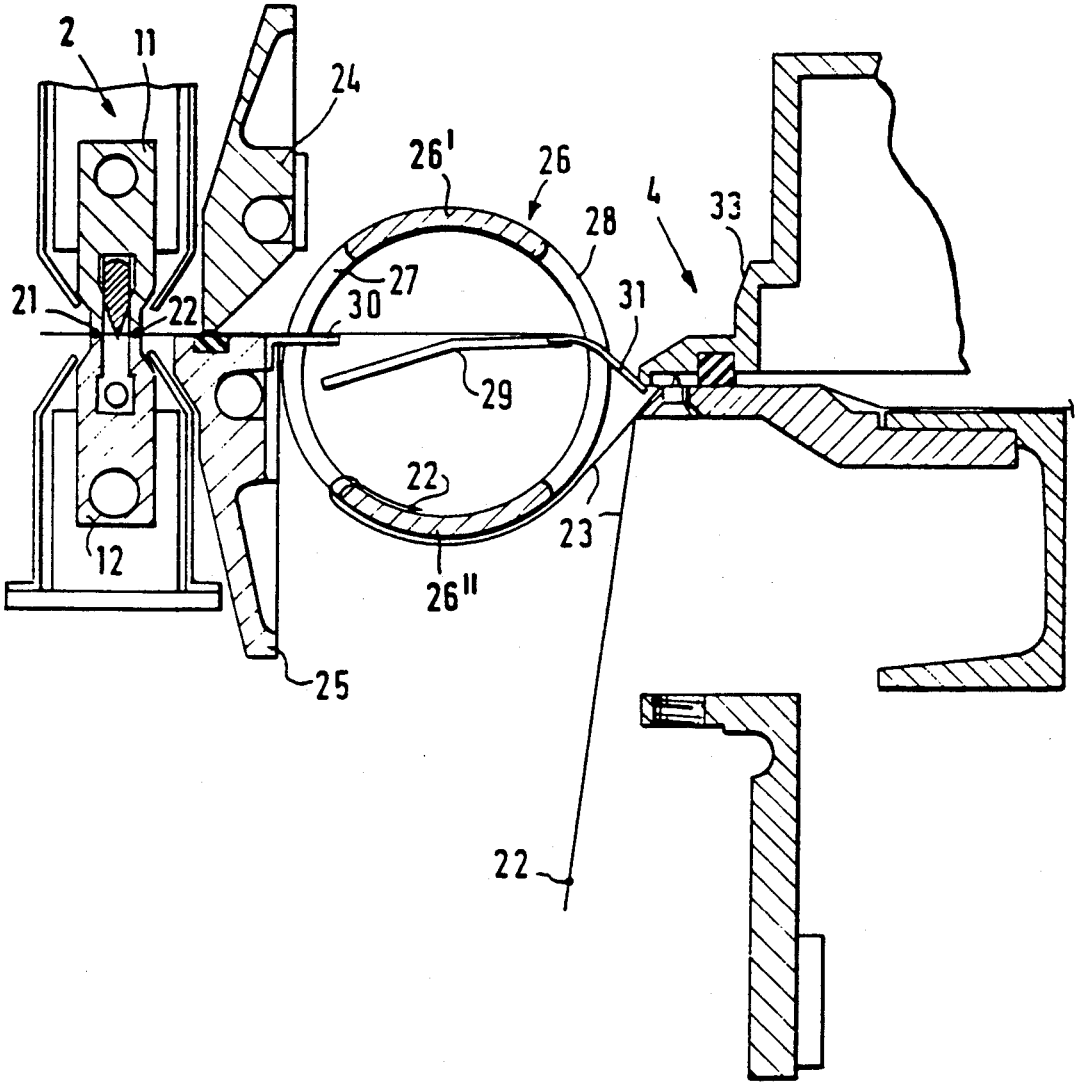
Figure 6:
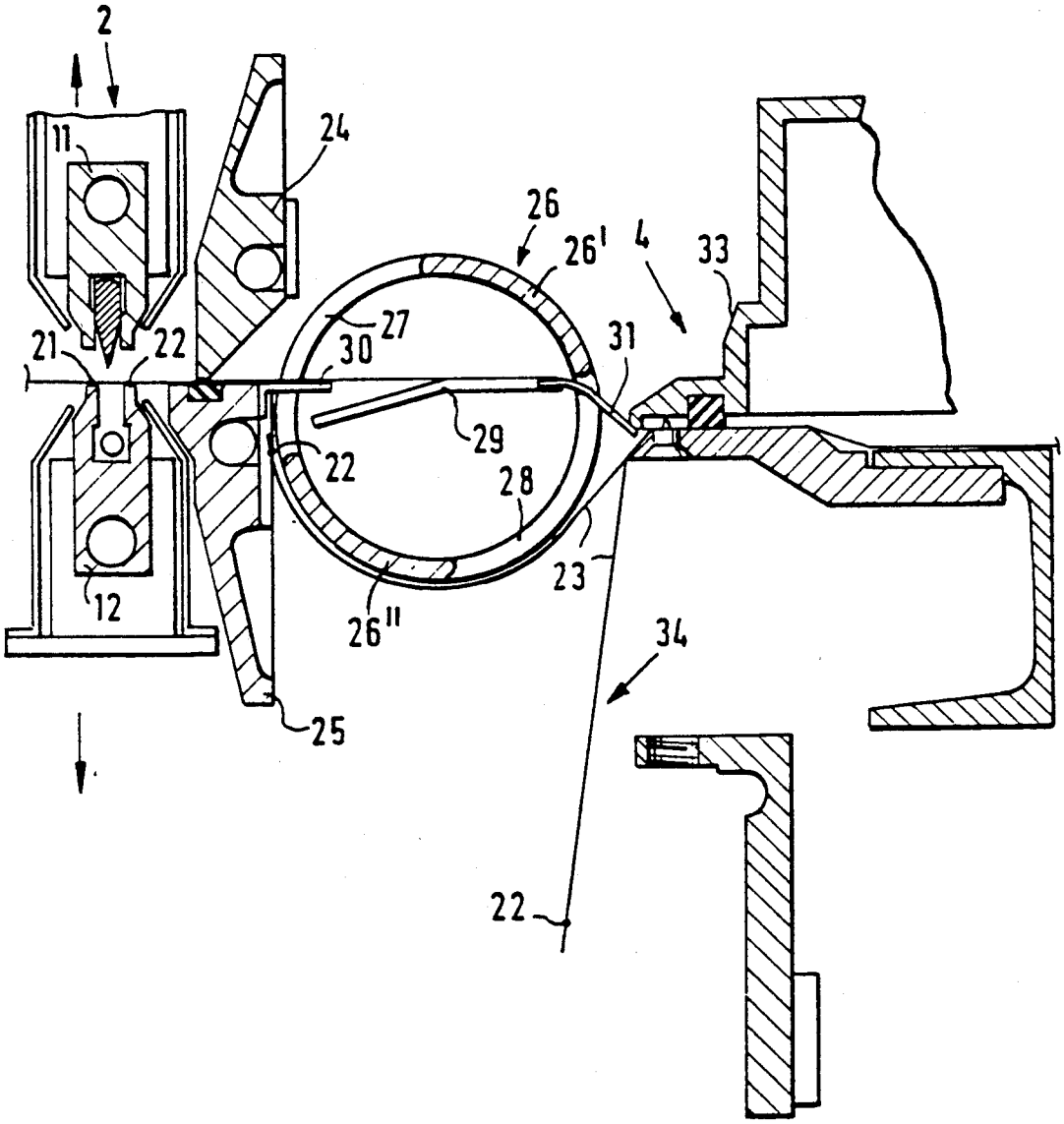

The operation of the device as described above will now be explained in more detail. In FIG. 2 the situation is illustrated in which two pieces of bag have been impaled on needles 32 in the stacking station 4. The last piece 23 of bag impaled is however not yet freely dependent, and the bottom end part is still partly wrapped on the lower outer surface part 26' of the tube 26. At this moment the pair of feed rolls is operated so that the tubular web is advanced, with the head seam 21 leading, the actual amount corresponding to the desired bag length. The end of this advancing movement is shown in FIG. 3. As shown in FIG. 3, the needles 32 are arranged so deep down that they do not interfere with the feed of the film web. The film web is moved between the two slots 27 and 28 in the tube 26 and rests partly on the sheet metal transfer member 29. After feeding, the two gripping jaws 24 and 25 move towards each other so that adjacent to the welding device 2 the film web is gripped on the one hand by the gripping jaws 24 and 25 on the other hand by the pair 1 of feed rolls. During the movement of the gripping jaws 24 and 25 towards each other the rail 33 of the stacking station 4 moves downwards so that the tubular film web is impaled on the needles 32 as shown in FIG. 4. As soon as this is completed, the two welding beams 11 and 12 are moved towards each other so that two weld seams 21 and 22 are produced between which the tubular film web is transversely cut by the knife 15. The position of the parts is illustrated in FIG. 5. Then directly after this the welding beams 11, 12 and the gripping jaws 24, 25 move apart, the tube 26 simultaneously being moved in the clockwise direction. As shown in FIG. 6, the bag which was impaled prior to the last welded bag begins to detach itself so that its end part comes clear of the outer surface part 26'' of the tube 26 and the bag is able to drop downwards and come to rest on the part of the stack 34. During rotation of the tube 26, the leading edge of the outer surface part 26' comes into contact with the last bag piece 23 cut off so that the same is entrained by the leading edge of the outer surface part 26', because the rail 33 is still kept in the lower position and holds the piece 23 of bag fast by gripping it. This situation is illustrated in FIG. 7. During the further, ensuing rotation of the tube 26 in clockwise direction, the tube will reach the position illustrated in FIG. 2, following which the bar 33 is lifted. In a similar manner these steps are repeated each time for the welding of a fresh piece of bag.

Owing to the use of the tube 26 the device as described above ensures that the bottom seams 22 have sufficient time to cool down before being laid on the bottom seams 22 of the bag pieces which are already impaled.

The use of the transfer sheet metal member 29 in the rotatable tube 26 means that there is satisfactory transfer of the leading piece of bag from the detaching device to the stacking station 4. In order to render the transfer completely reliable, strips 30 and 31 are provided, which must more particularly be present if the apparatus is operated with a comb constituted by jets of air by which the film is removed from the feed roll pair. The strips 30 and 31 then in fact stop any turbulence occurring adjacent to tube 26. The upper sheet metal guide 29 is bent downwards on its side facing the welding device 2 so that the strip 30 rests on the sheet metal transfer member 29 even when the gripper jaw 25 is lowered.

What is claimed is:

1. Apparatus for providing transverse weld seams in, and for detaching sections of, an intermittently moving tubular or semi-tubular web of thermoplastic synthetic resin and for stacking the detached sections, comprising:

a transverse welding and transverse detaching station (2) for detaching sections provided with bottom weld seams and any leading head weld seams from the web, a stacking station (4) comprising means for depositing and retaining the detached sections, a drum (26) disposed between the transverse welding and transverse detaching station (2) and the stacking station (4), a cylindrical surface thereof comprising at least two wall parts, means for rotating said drum about a transverse axis thereof, incrementally in step with welding through an angular increment which amounts to a fraction of a revolution corresponding to the number of parts of the cylindrical wall (360°/number of parts), a sheet metal guide (29) arranged generally in a horizontal plane within the drum, and means for pushing the web across the sheet metal guide, wherein, in step with depositing the detached sections in the stacking station, the web is pushed through gaps between the wall parts of the drum between the transverse welding and transverse detaching station and the stacking station, across a surface of the sheet metal guide.

2. Apparatus as claimed in claim 1, wherein the drum (26) is provided with two mutually opposite wall parts (26') and (26'') having the form of cylindrical shells.

3. Apparatus as claimed in claim 1, wherein a longitudinal plenum (35) is arranged on the lower side of the sheet metal guide (29) connected with an air duct, a lower wall of the plenum being provided with air discharge nozzles.

4. Apparatus as claimed in claim 1, wherein a part of the sheet metal guide (29) nearest the transverse welding and transverse detaching station (2) is bent or angled downwards.

5. Apparatus as claimed in claim 1, wherein a pair of gripping jaws (24 and 25) is arranged between the transverse welding and transverse detaching station, a lower jaw (25) thereof carrying an elastic strip (30) in such a manner that it bears on the edge part of the sheet metal guide (29) in the gaps between two rods or the like.

6. Apparatus as claimed in claim 5, wherein a lower jaw (25) of the pair of jaws (24 and 25) is adapted to be lowered and lifted.

7. Apparatus as claimed in claim 1, wherein an elastic strip (31) is arranged on the edge part of the sheet metal guide (29) facing the stacking station (4), said strip (31) extending between rods or the like of the drum (26) in a radial direction.

8. Apparatus as claimed in claim 1, wherein needles holding a stack in the course of formation are located on the stacking station (4) enabling the stack to be arranged with a free end (34) depending freely downwards between the drum (26) and a rear edge of a stacking table.

* * * * *